US006565175B1

(12) United States Patent
Scardovi et al.

(10) Patent No.: US 6,565,175 B1
(45) Date of Patent: May 20, 2003

(54) INTEGRATED PRINTHEAD

(75) Inventors: Alessandro Scardovi, Ivrea (IT); Renato Conta, Ivrea (IT)

(73) Assignee: Olivetti Tecnost S.p.A., Ivrea (IT)

( * ) Notice: Subject to any disclaimer, the term of this patent is extended or adjusted under 35 U.S.C. 154(b) by 0 days.

(21) Appl. No.: 10/030,631

(22) PCT Filed: Jun. 30, 2000

(86) PCT No.: PCT/IT00/00271

§ 371 (c)(1),
(2), (4) Date: Jan. 11, 2002

(87) PCT Pub. No.: WO01/03932

PCT Pub. Date: Jan. 18, 2001

(30) Foreign Application Priority Data

Jul. 12, 1999 (IT) ..... TO99A0609

(51) Int. Cl.[7] ..... B41J 29/38
(52) U.S. Cl. ..... 347/12; 347/150
(58) Field of Search ..... 347/12, 180, 181, 347/211; 400/120.05, 120

(56) References Cited

U.S. PATENT DOCUMENTS 5,644,342 A 7/1997 Argyres ..... 347/12
6,402,279 B1 * 6/2002 Torgerson et al. ..... 347/12
6,431,677 B1 * 8/2002 Anderson et al. ..... 347/12

FOREIGN PATENT DOCUMENTS

EP 0 388 073 3/1990 ..... B41J/2/05
EP 0 592 221 10/1993 ..... G06K/15/10

* cited by examiner

*Primary Examiner*—Thinh Nguyen
*Assistant Examiner*—Alfred Dudding
(74) *Attorney, Agent, or Firm*—Banner & Witcoff, Ltd.

(57) ABSTRACT

This invention relates to an integrated printhead (20) for ink jet printers, wherein the addressing of the various nozzles is effected in at least 3-D mode. The head (20) comprises a plurality of groups (24) of ink jet elements (21, 22) arranged in M rows and L columns wherein, in particular, the selection and activation of the different columns L are performed, under the control of an external drive circuit, by means of logic circuits (25) inside the head itself (20). The head (20) is advantageous with respect to the known art in that it does not require control of the L columns under critical conditions such as highly variable electric currents with very high peak values.

5 Claims, 2 Drawing Sheets

INTEGRATED PRINTHEAD

This is a U.S. National Phase Application Under 35 USC 371 and applicant herewith claims the benefit of priority of PCT/IT00/000271 filed Jun. 30, 2000, which was published Under PCT Article 21(2) in English and Application No. TO99A000609 filed in Italy on Jul. 12, 1999.

TECHNICAL FIELD

This invention relates to an integrated printhead comprising an array of groups of ink jet elements in M rows and L columns wherein each group has a single row and column address, first addressing means $P_J$ associated with the array of groups for selecting one of the M rows of the array of groups of ink jet elements in M rows and L columns, second addressing means $X_K$ associated with the array of groups for selecting one of the L columns of the array of groups of ink jet elements in M rows and L columns, and third addressing means $A_I$ associated with the array of groups for selecting one ink jet element in each group of ink jet elements.

In particular, this invention relates to a thermal ink jet head of the IDH type (Integrated Drive Head) wherein a plurality of thermal resistances or resistors are selectively activated by an external control circuit to produce the emission of droplets of ink through nozzles placed in correspondence with the resistors.

BACKGOUND ART

An IDH integrated printhead is known from the U.S. Pat. No. 5,644,342 wherein addressing of the various resistors is effected via three-dimensional (or 3-D) addressing.

The known head 10 (FIG. 1) comprises a plurality of resistors 11 each connected to a power transistor 12. The activation of the resistors 11 is controlled by means of an external control circuit connected to the head 10 itself through two corresponding flexible circuits (head flat cable and printer flat cable) having a plurality of contact points $A_{I=1-N}$, $P_{J=1-M}$, $GND_{K=1-L}$ where:

N is the number of resistors 11 or addresses $A_I$ that can be selected inside an activating group 14;

M is the number of pairs of primitives $P_J$ that can be selected; and

L is the number of ground contacts $GND_K$ or columns that can be selected.

For example, a head of 624 nozzles can be produced, according to the known art, from an integrated circuit comprising 24 pairs (M) of activating groups 14 with 13 (N) resistors 11 and associated transistors 12.

Accordingly:

M+N+L=39 contacts allows the external circuit to control the selective activation of 24*13*2=624 nozzles by activating the ground connection of a column of primitives through a ground contact $GND_{K=1-L}$ (Ground Select);

by activating, for a determined time and by means of the transistors 12, a first address $A_I$ (Address Line Select);

by electrically powering, within the column activated, with predefined current pulses and by means of the contacts $P_J$ (Primitive Select), a predefined configuration of primitives corresponding to the first address $A_I$;

by activating in sequence a second address $A_I$ (Address Line Select) and the relative transistors 12;

by electrically powering, within the column activated, with predefined current pulses and by means of the contacts $P_J$ (Primitive Select), a second predefined configuration of primitives corresponding to the second address $A_I$;

and so on in successive steps until activation of the N addresses is complete, and then continuing in similar fashion after de-activating the ground connection of the first column of primitives and activating that of the second column of primitives.

As is known, with 3-D addressing it is possible to limit the number of contact points between head and control circuit when the number of nozzles is very high. This is very important since, as is known, integrated heads are economically advantageous and reliable only if the number of contacts is limited to 50–60; indeed, it is only by limiting the number of contacts that it is possible to limit the surface of the integrated circuit constituting the head, the surface of the head flat cable and/or of the head flat cable/printer flat cable area of contact.

For example, as will be apparent to those acquainted with the sector art, the head with 624 nozzles of FIG. 1, if made with 2-D addressing, would not be economically advantageous as it would require:

2*24 (M)+13 (N)+24 (GND)=85 contacts.

But 3-D form addressing made in the known way of FIG. 1 presents a certain number of technical problems compromising its reliability and use possibilities.

A first problem consists of the fact that the intensity of current in the contact points $GND_{K=1-L}$ between head flat cable and printer flat cable, being directly proportional to the primitives $P_J$ powered simultaneously, may assume extremely variable values, for example between 250 mA and 6 Ampere (24*250 mA), assuming naturally that the minimum activating current of a resistor 11 is 250 mA. As will be obvious to those acquainted with the sector art, head flat cable/printer flat cable pressure contacts with these current values are not reliable or repeatable over time.

A second technical problem lies in the fact that the switches in the external control circuit for the ground contacts $GND_K$ must be over-sized so as to be capable of supporting, for example, peak current values of magnitude 6 Ampere with very low resistances for closing the switches in question.

A third technical problem lies in the fact that the layout of this 3D type integrated head is very critical with regard to the ground conductors, which must support variable and very high peak currents in the head flat cable/printer flat cable contacts, and which have high parasitic resistances, with variable paths and high and variable voltage drops.

A fourth technical problem lies in the fact that the head flat cable/printer flat cable pressure contacts, with regard in particular to the contact points $GND_{K=I-L}$, may cause sparks and electric discharges in the presence of high peak currents.

In short, the known 3-D integrated heads, due to the grouping of the ground connections, imply technical problems that are difficult to solve and signify poor reliability, production difficulties and variability of the power supplied to the resistors 11 for activating the emission of ink from the nozzles.

DISCLOSURE OF THE INVENTION

The object of this invention is to overcome the technical problems outlined above with an innovative integrated head layout which, at the same time, has the advantages of 3-D addressing and, unlike the known art, is easy to produce and reliable.

This object is attained by the integrated printhead characterised by logic means associated with each group of ink jet elements and with the second addressing means $X_K$ and suitable for being activated by logic signals for selecting one of the L columns of the array of groups of ink jet elements.

According to another characteristic of this invention, the integrated printhead, to advantage, may be driven by the control circuit via a four-dimensional, or 4-D, form of addressing.

BRIEF DESCRIPTION OF DRAWINGS

This and other characteristics of this invention will become apparent from the following description of a preferred embodiment, provided as a non-restrictive example, with the help of the accompanying drawings, where.

BEST MODE FOR CARRYING OUT THE INVENTION

Figure 1:
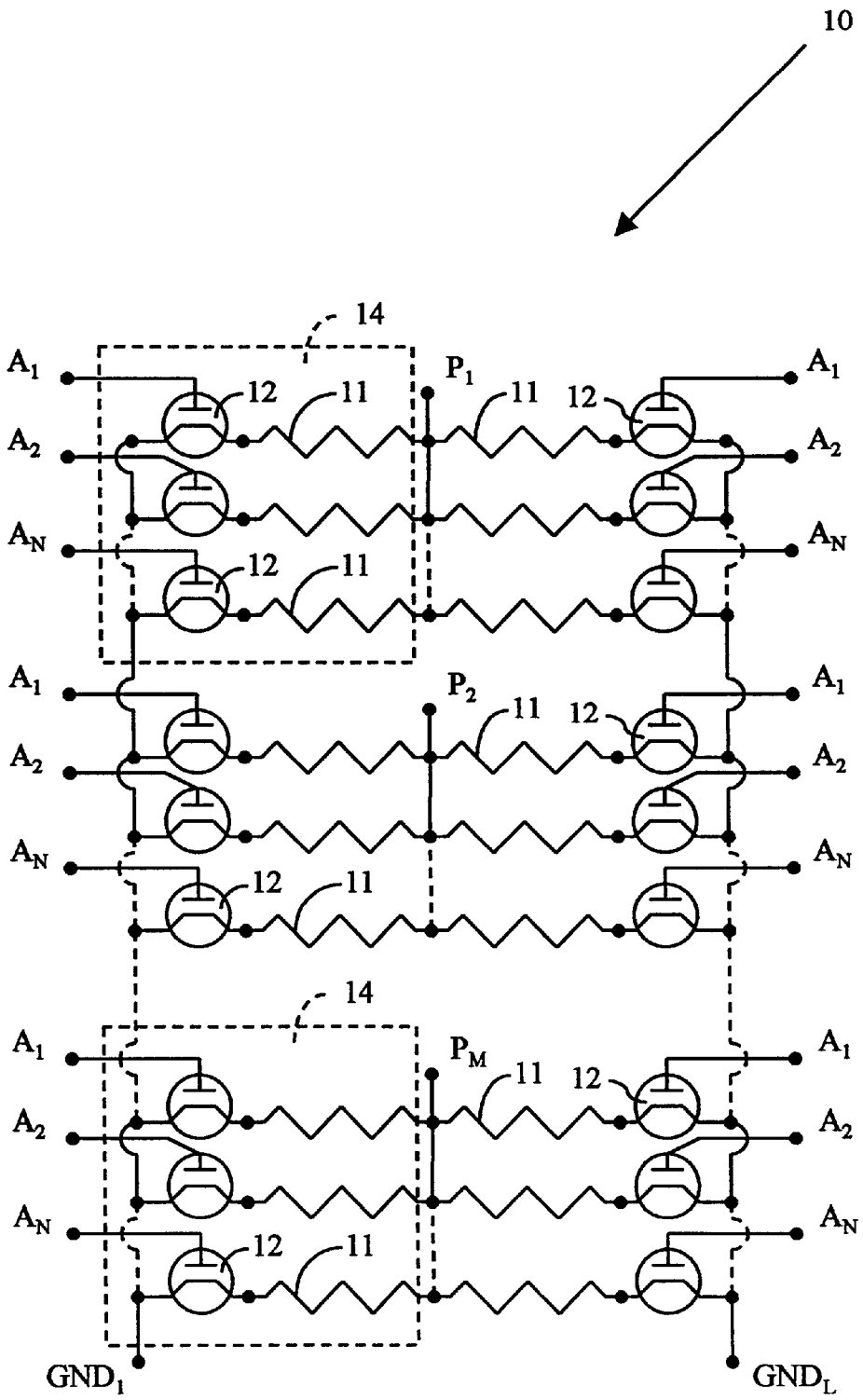
FIG. 1 represents a logical diagram of an 3-D integrated printhead according to the known art.
Figure 2:
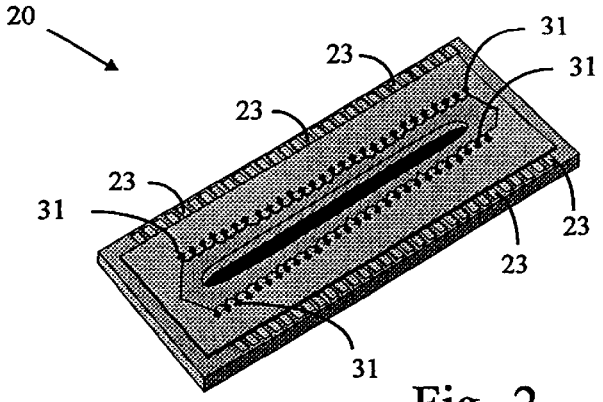
FIG. 2 represents an overall view of an integrated printhead.

With reference to FIG. 2, an integrated printhead (head) 20, according to the invention, comprises a predefined number of nozzles 31, for example 624 nozzles, located on the head 20 according to a predefined order and suitable for emitting ink on to a medium, generally paper, and a predefined number of contacts 23 suitable for connecting the head 20 to a drive or control circuit, not depicted in the figure, suitable for controlling the selective activation of the nozzles 31.

Figure 3:
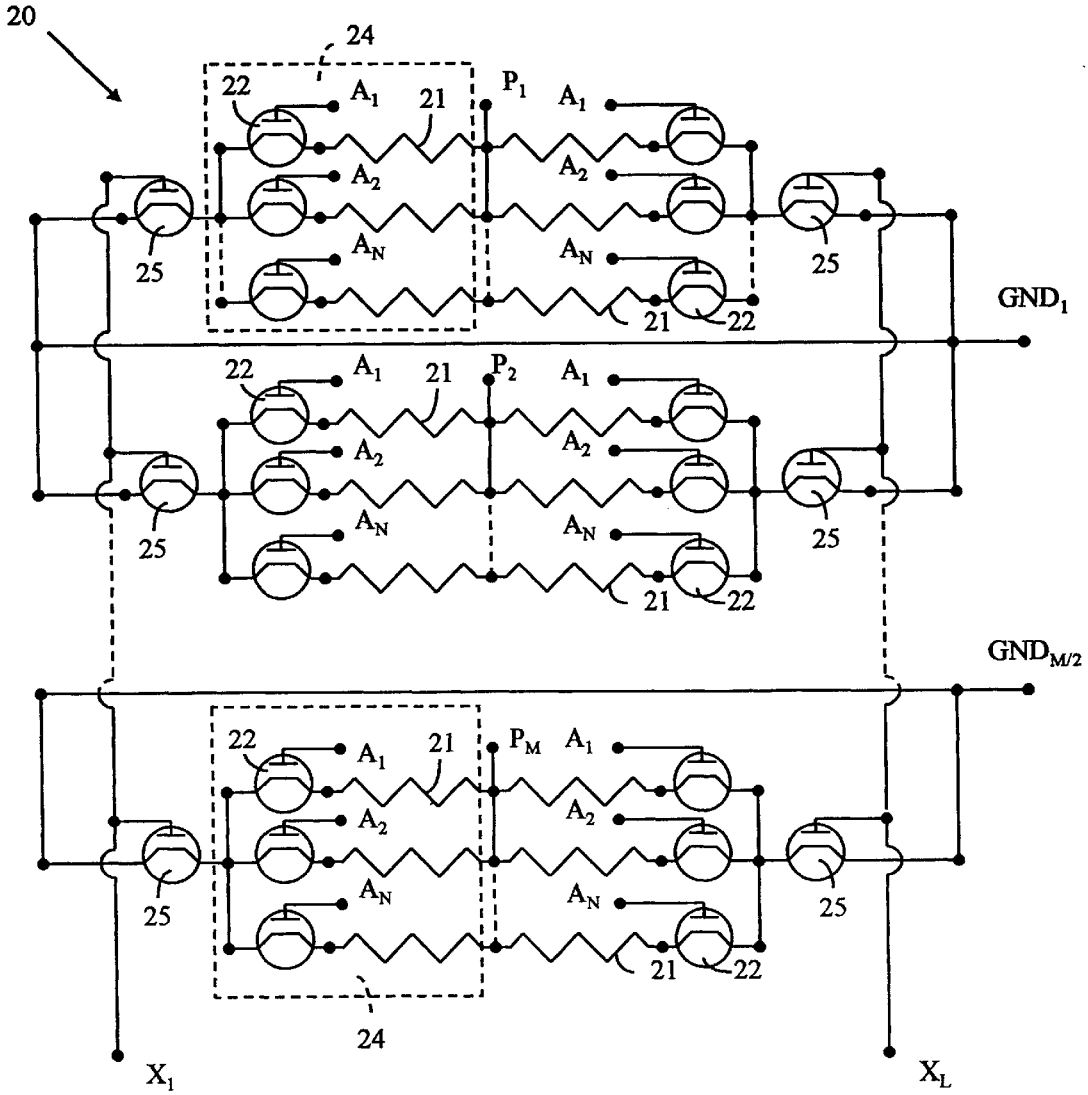
FIG. 3 represents a logical diagram of the circuit elements of an integrated head according to the invention.

The head 20, made of an integrated circuit, for example of the NMOS or bipolar type, also comprises a predefined number of activating groups 24 (FIG. 2, FIG. 3), of known type, for example 24 pairs (M) of activating groups 24 and, in accordance with one of the main characteristics of this invention, an equivalent number of transistors ($SW_{AND}$ transistors) 25, each one associated with one activating group 24.

Each activating group 24, of known type, comprises a predefined number N of transistors (array transistors) 22 and an equivalent number of thermal resistances (resistors) 21 which are suitable for producing, in a known way, the emission of ink from the nozzles 31.

For example, in a head with 624 nozzles 31 which has 48 activating groups, N is equal to 13 (48*13=624).

Each array transistor 22, of known type, has its drain terminal connected to one of the two terminals of the resistor 21, its source terminal connected in common to the source of the array transistors 22 belonging to the same activating group 24 and its gate terminal connected to the contacts 23 corresponding to the address selection lines (Address Line Select or addresses) $A_{I=1-N}$.

By way of logic signals and in a known way, the control circuit is, therefore, suitable for activating in sequence the addresses $A_I$ and, as a result, the N gates of the array transistors 22 of all the activating groups 24.

The resistors 21 belonging to a pair of activating groups 24 arranged in different columns, have the second terminal connected in common and to a contact 23 corresponding to a power feed line of the primitives (Primitive Select or primitive) $P_{J=1-M}$.

By means of these contacts $P_J$, the drive circuit is suitable, in a known way, for electrically powering, upon variation of the addresses $A_I$, predefined configurations of primitives so as to activate the emission of ink from the nozzles corresponding to the active address $A_I$ and to the primitive configuration powered.

Each $SW_{AND}$ transistor 25, of known type, has the drain connected to the sources of the transistors 22 belonging to an activating group 24 and the gate connected in common to all the $SW_{AND}$ transistors 25 belonging to the same column (even or odd) and to a contact 23 corresponding to a column selection line (Column Select or column) $X_{K=1-L}$.

Accordingly, in accordance with one characteristic of this invention, through the contacts $X_K$ the drive circuit is suitable for activating, in sequence and with logic signals only, the M gates of the $SW_{AND}$ transistors 25 and consequently for activating, for example, the emission of ink from the even column or from the odd column of nozzles 31.

In the preferred embodiment, the source of the $SW_{AND}$ transistor 25 of a predefined activating group 24 is connected to the source of the $SW_{AND}$ transistor 25 belonging to the same primitive $P_J$ and different column, to the pair of sources of the $SW_{AND}$ transistors 25 belonging to the adjacent primitive $P_{J+1}$ and to a contact 23 corresponding to a ground connection $GND_{G=1-M/2}$.

Through each ground connection $GND_{G=1-M/2}$ the drive circuit is suitable, in accordance with a further characteristic of this invention, for discharging to ground an activating current which, as will be obvious to those acquainted with the sector art, at most is equal to twice the single activating current, for example 500 mA (250 mA*2).

Therefore the head 20, according to this invention, allows the drive circuit to control in 3-D fashion the selective activation, for example, of 624 nozzles:

with a limited number of contacts 24 (M)+13 (N)+2 (L)+12 (M/2)=51 contacts in which M is the number of primitives;

N the number of addresses per primitive;

L the number of columns; and

M/2 the number of ground contacts; and with low ground currents on the single ground contacts $GND_G$.

Operation of the printhead 20 described up to now depends on how the drive circuit is programmed and is therefore described with reference to the latter.

The drive circuit, through the connections $X_K$ and with a logic signal on the gates of the $SW_{AND}$ transistors 25, activates a column of primitives, for example column $X_1$ and keeps it active until, in the same way as already described for the known 3-D heads, scanning is performed of the addresses $A_I$ and the corresponding configurations of primitives are powered.

Once scanning of the addresses of the first column $X_1$ is complete, the drive circuit, in sequence, de-activates the first column and, through the connections $X_K$ and with a logic signal on the gates of the $SW_{AND}$ transistors 25, activates a second column of primitives, for example, column $X_2$, so that scanning is performed of the addresses $A_I$ and the corresponding configurations of primitives relative to the second column are powered.

The drive circuit will proceed in sequence to activate alternatively the $X_K$ columns of primitives so that the emission of ink by the corresponding nozzles 31 of the head is activated.

Naturally the activation by the drive circuit of the nozzles 31 may be effected in different ways, for example by alternatively activating and de-activating the columns $X_K$ of nozzles, for a like address $A_I$ selected, and by varying the corresponding configuration of primitives, without any impact on the structure of the printhead described.

Thanks to the type of structure described, the printhead 20 can also be controlled in 4-D mode, by arranging for example for the drive circuit to selectively control, through the ground contacts $GND_{G=1-M/2}$ (Ground Select), the ground connection of the groups of primitives having a common ground.

Moreover, the number L of connections $X_K$, which in the preferred embodiment is 2, may be increased, without in any way departing from the spirit of the invention.

For example, with a structure like the one described, a printhead with 600 nozzles may be produced wherein the number M of primitives is 24, the number N of addresses per primitive is 5 and the number L of columns 5, using:
24 (M)+5 (N)+5 (L)+12 (M/2)=46 contacts and obtaining, naturally, (24*5*5) 600 nozzles.

The printhead 20, according to the invention, has considerable advantages with respect to the known art which may be resumed, though the list is not exhaustive, as follows:

- the layout of the head is not critical, particularly with regard to the ground conductors;
- a single elementary peak current transits through each pair of transistors, array transistor 22 and $SW_{AND}$ transistor 25, and therefore the voltage drops on the interconnections are constant and the dissipated power depends solely on the total resistance during conduction ($R_{ON}$) of the array transistor 22 and of the $SW_{AND}$ transistor 25 in series;
- the maximum current on each ground contact $GND_G$, when allowance is made for, as in the preferred embodiment, one ground for every 4 primitives, corresponds to twice the activating current of the resistors 21;
- the 3-D addressing of the head is performed with a logic level on the gate of the $SW_{AND}$ transistors and therefore the contacts $X_K$, by means of which the column of primitives to be activated is selected, are not subject to any risk of sparks as in the known art.

Naturally, changes may be made to the dimensions, shapes, materials, components, circuit elements, connections and contacts, as also to the circuitry and construction details illustrated and to the method of operation without departing from the spirit of this invention.

What is claimed is:

1. An integrated printhead comprising an array of groups of ink jet elements in M rows and L columns wherein each group has a single row and column address;

first addressing means $P_J$ associated with the array of groups for selecting one of the M rows of the array of groups of ink jet elements in M rows and L columns;

second addressing means $X_K$ associated with the array of groups for selecting one of the L columns of the array of groups of ink jet elements in M rows and L columns; and third addressing means $A_I$ associated with the array of groups for selecting an ink jet element in each group of ink jet elements; and logic means associated with each group of ink jet elements and with the second addressing means $X_k$ and suitable for being activated with logic signals for selecting one of the L columns of the array of groups of ink jet elements.

2. A printhead according to claim 1 wherein said logic means comprises at least one transistor having a terminal connected to a group of ink jet elements, a terminal connected to ground and a control terminal connected to said second addressing means $X_K$.

3. A printhead according to claim 1, wherein fourth addressing means $GND_G$ are provided, associated with the arrays of groups of ink jet elements for selecting one or more groups G of the M rows of the array of groups of ink jet elements.

4. A printhead according to claim 3, wherein each group G comprises 2 rows and L columns of the M rows of the array of groups of ink jet elements.

5. Printhead according to claim 3, wherein said logic means has a terminal connected to a group of ink jet elements, a terminal connected to second addressing means $X_K$ and a terminal connected to the fourth addressing means $GND_G$.

* * * * *